US010689069B2

(12) United States Patent
Araki et al.

(10) Patent No.: US 10,689,069 B2
(45) Date of Patent: Jun. 23, 2020

(54) PERSONAL WATERCRAFT

(71) Applicant: KAWASAKI JUKOGYO KABUSHIKI KAISHA, Kobe-shi, Hyogo (JP)

(72) Inventors: Toshio Araki, Kakogawa (JP); Hironori Kato, Kakogawa (JP); Tadao Minesaki, Kobe (JP); Minoru Kanamori, Rowland Heights, CA (US)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/110,165

(22) Filed: Aug. 23, 2018

(65) Prior Publication Data

US 2020/0062353 A1 Feb. 27, 2020

(51) Int. Cl.
*B63B 35/73* (2006.01)
*B63B 32/20* (2020.01)

(52) U.S. Cl.
CPC ..... *B63B 32/20* (2020.02)

(58) Field of Classification Search
CPC ..... B63B 35/73; B63B 35/731; B63B 35/81; B63B 2035/73; B63B 2035/737; B63B 2035/81
USPC ..... 114/55.5–55.57
See application file for complete search history.

(56) References Cited

U.S. PATENT DOCUMENTS 5,676,086 A * 10/1997 Watkins ..... B63B 35/731 114/343
5,857,423 A * 1/1999 Imaeda ..... B63B 17/0018 114/363
6,192,823 B1 * 2/2001 Tsumiyama ..... B63B 27/143 114/363
6,530,336 B2 3/2003 Ibata et al.
6,932,011 B2 * 8/2005 Nagata ..... B63B 17/00 114/362

* cited by examiner

*Primary Examiner* — Daniel V Venne
(74) *Attorney, Agent, or Firm* — Alleman Hall Creasman & Tuttle LLP

(57) ABSTRACT

A personal watercraft comprises a body including a deck; and a seat disposed on the deck at a location that is forward of a rear end of the deck. The deck includes a depressed part formed by depressing a portion of the deck which is rearward of the seat. The depressed part includes a bottom wall surface extending in a forward and rearward direction and in a rightward and leftward direction.

9 Claims, 4 Drawing Sheets

PERSONAL WATERCRAFT

BACKGROUND OF THE INVENTION

Field of the Invention

The present invention relates to a personal watercraft which ejects a water jet of water taken into a body thereof to plane on a water surface, in a state in which a person (rider and/or passenger or the like) is seated on a seat provided on a deck.

Description of the Related Art

For example, U.S. Pat. No. 6,530,336 discloses a personal watercraft which ejects a water jet of water taken into a body thereof to plane on a water surface. In the personal watercraft, typically, a person (rider and/or passenger or the like) is seated on a seat in a state in which the person sees a forward side. In some cases, a player enjoys water sport such as wakeboarding by utilizing the personal watercraft. In these cases, while the player is ready to play the water sport such as the wakeboarding, or taking a break, the player may be seated on a portion of the deck which is rearward of the seat in a state in which the player sees a rearward (backward) side. For this reason, the personal watercraft is required to be designed so that the player can be stably seated on a portion of the deck which is rearward of the seat in a state in which the player sees a rearward side and can quickly start to play the water sport such as the wakeboarding.

SUMMARY OF THE INVENTION

In view of the above-described circumstances, an object of the present invention is to provide a personal watercraft which allows a player who plays water sport such as wakeboarding by utilizing the personal watercraft to be stably seated on a portion of a deck which is rearward of a seat in a state in which the player sees a rearward side and can quickly start to play the water sport such as the wakeboarding.

According to an aspect of the present invention, a personal watercraft comprises a body including a deck; and a seat disposed on the deck at a location that is forward of a rear end of the deck, wherein the deck includes a depressed (recessed) part formed by depressing (recessing) a portion of the deck which is rearward of the seat, and wherein the depressed part includes a bottom wall surface extending in a forward and rearward direction and in a rightward and leftward direction.

In accordance with this configuration, in the personal watercraft, a player is seated on the depressed part including the bottom wall surface extending in the forward and rearward direction and in the rightward and leftward direction. In this way, the rider can be stably seated on a portion of the deck which is rearward of the seat. When the player raises the body from the depressed part, the player can quickly start to play water sport such as wakeboarding.

The above and further objects, features and advantages of the present invention will more fully be apparent from the following detailed description of preferred embodiment with reference to the accompanying drawings.

DETAILED DESCRIPTION OF THE PREFERRED EMBODIMENTS

Figure 1:
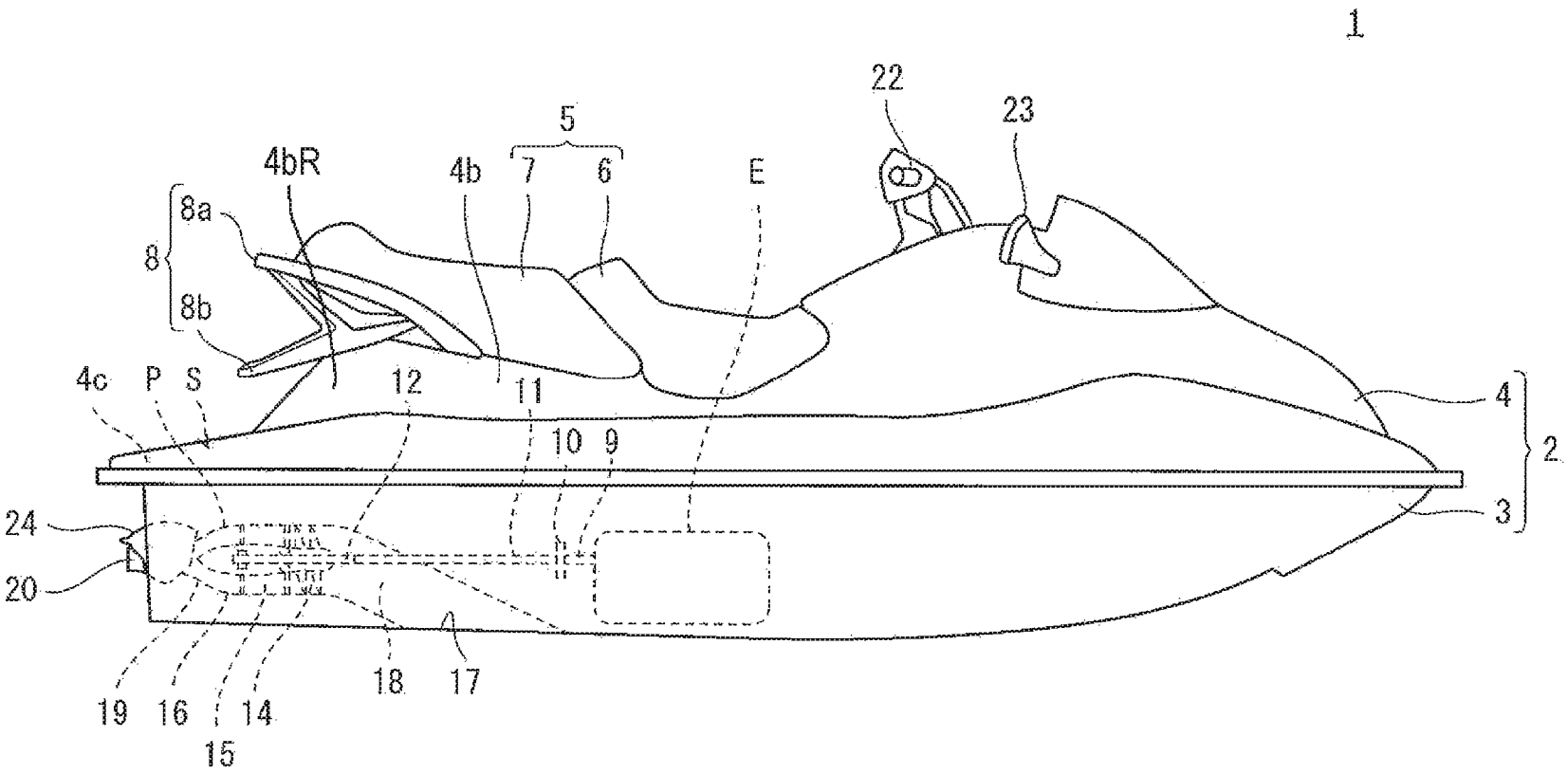
FIG. 1 is a side view of a personal watercraft according to an embodiment.
Figure 2:
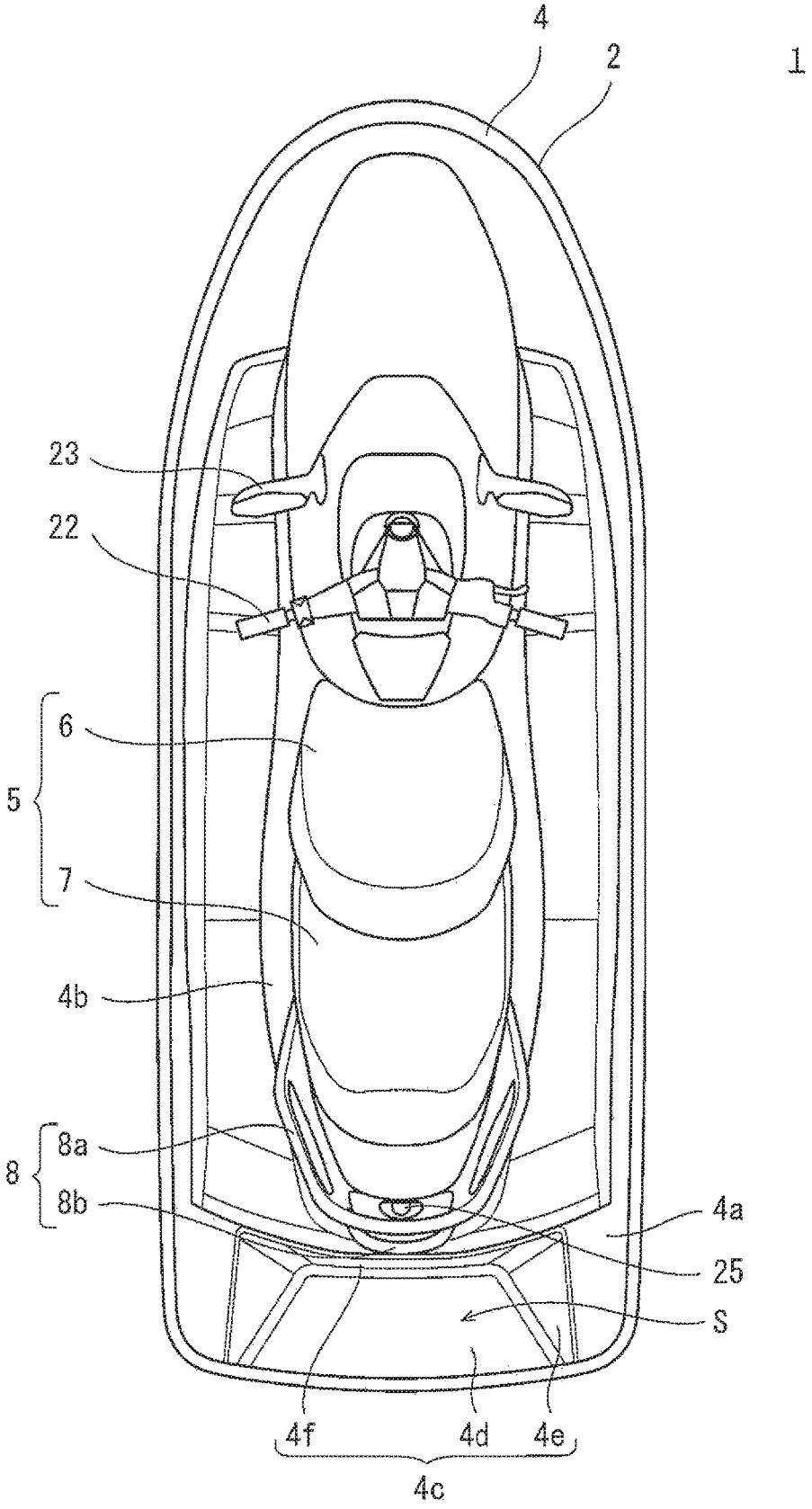
FIG. 2 is a top plan view of the personal watercraft of FIG. 1.
Figure 3:
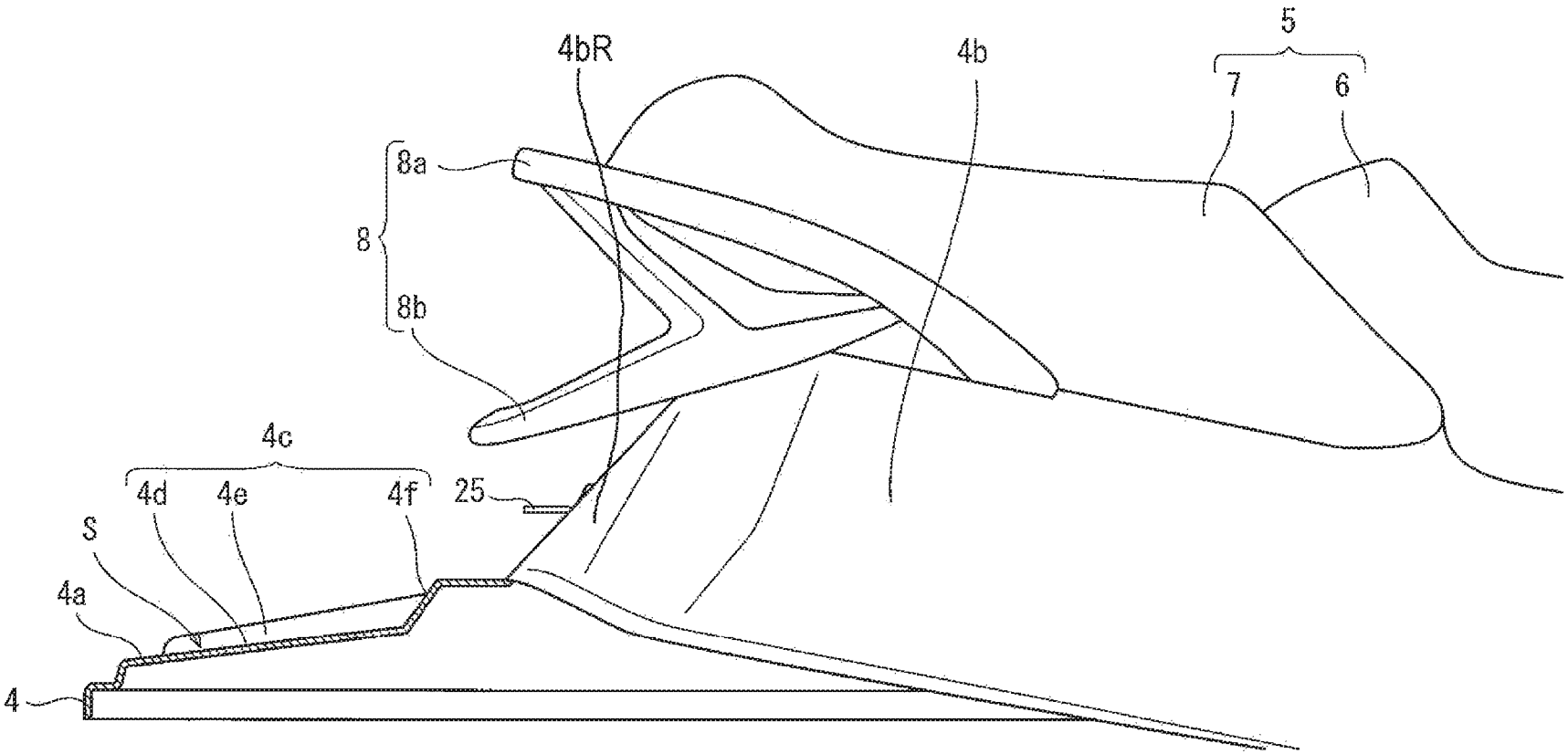
FIG. 3 is a right side view of the rear portion of the personal watercraft of FIG. 1.
Figure 4:
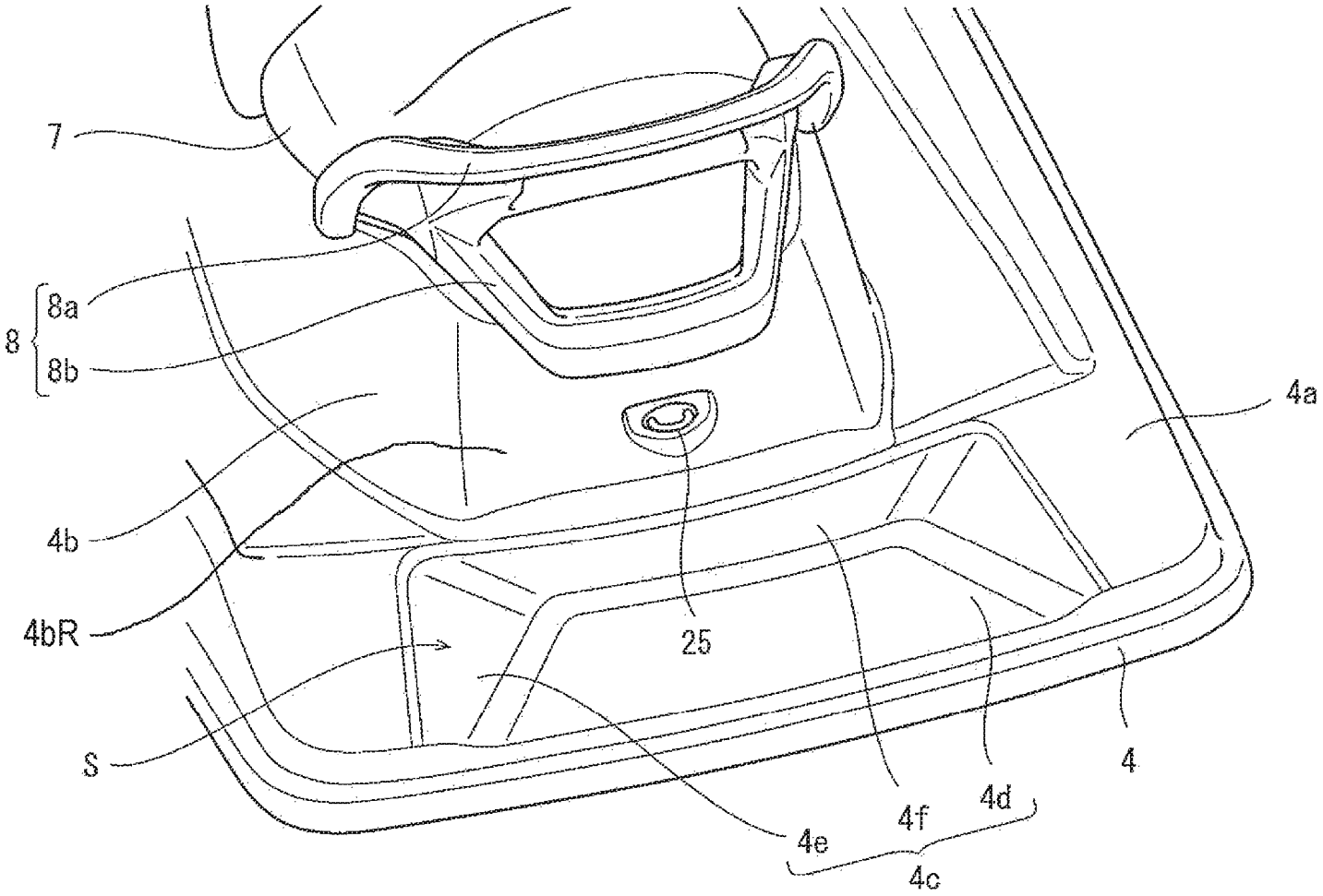
FIG. 4 is a perspective view of the rear portion of the personal watercraft of FIG. 1, when viewed from the left and the rear.

Hereinafter, the embodiment of the present invention will be described with reference to the drawings. The stated directions (forward and rearward direction and rightward and leftward direction) are from the perspective of a person (rider and/or player or the like) on a personal watercraft 1. FIG. 1 is a side view of the personal watercraft 1 according to the embodiment. FIG. 2 is a top plan view of the personal watercraft 1 of FIG. 1. FIG. 3 is a right side view of the rear portion of the personal watercraft 1 of FIG. 1. FIG. 3 shows a vertical section of a depressed (recessed) part 4*c* of a deck 4, the vertical section being perpendicular to the rightward and leftward direction. FIG. 4 is a perspective view of the rear portion of the personal watercraft 1 of FIG. 1, when viewed from the left and the rear.

Referring to FIGS. 1 and 2, the personal watercraft 1 includes a body 2, a seat 5, and a rear grip 8. The body 2 includes a hull 3 and the deck 4 covering the upper portion of the hull 3. The personal watercraft 1 includes a seat 5 on which a person (rider and/or passenger or the like) is seated in a state in which the person straddles the seat 5.

The seat 5 is disposed on the deck 4 at a location that is forward of the rear end of the deck 4. The seat 5 includes a front seat 6 and a rear seat 7. Of persons riding on the personal watercraft 1, the rider who steers the personal watercraft 1 is seated on the front seat 6. Of the persons riding on the personal watercraft 1, for example, a player who plays water sport such as wakeboarding by utilizing the personal watercraft 1, is seated on the rear seat 7. In normal cases, these persons are seated on the seat 5 in a state in which they see a forward side. In a case where the player plays the water sport such as the wakeboarding, a monitoring person (observer) who monitors (observes) the player may be seated on the seat 5 in a state in which the monitoring person sees a rearward (backward) side.

The rear grip 8 protrudes rearward from the rear portion of the seat 5. The rear grip 8 includes a first grip part 8*a* and a second grip part 8*b* disposed below the first grip part 8*a*. The rear end of the second grip part 8*b* is located rearward of the rear end of the first grip part 8*a*.

The deck 4 includes a deck floor 4*a* and a seat support part 4*b*. The deck floor 4*a* extends in the forward and rearward direction and in the rightward and leftward direction, and is disposed laterally of the seat 5. The persons riding on the personal watercraft 1 rest their feet on the deck floor 4*a*. The seat support part 4*b* extends upward from the upper surface of the deck floor 4*a* and supports the seat 5. The rear portion of the seat support part 4*b* is inclined in an upward direction, from the rear to the front. The rear portion of the seat support part 4*b* is provided with a connection member 25 used to connect a rope to the personal watercraft 1 in a case where the player plays the water sport such as the wakeboarding by utilizing the personal watercraft 1.

Inside the body 2, an engine E which is an example of a driving power source (prime mover) is accommodated. An output shaft 9 (crankshaft) of the engine E extends rearward in the body 2. The output end portion of the output shaft 9 is connected to a propeller shaft 11 via a coupling member 10. A water jet pump P is disposed at the rear portion of the hull 3. A propeller shaft 11 is coupled to a pump shaft 12 of the water jet pump P. The pump shaft 12 is rotatable with the rotation of the output shaft 9.

An impeller 14 is mounted on the pump shaft 12. A fairing vane 15 is disposed rearward of the impeller 14. A tubular pump casing 16 is provided at the outer periphery of the impeller 14 to cover the impeller 14.

A water intake 17 opens in the bottom portion of the body 2. The water intake 17 and the pump casing 16 are in communication with each other via a water passage 18 extending in the forward and rearward direction. A pump nozzle 19 is provided at the rear portion of the body 2 and connected to the pump casing 16. The pump nozzle 19 has a diameter which is reduced from the front to the rear. An ejection port opens in the rear end of the pump nozzle 19. A steering nozzle 20 is connected to the ejection port of the pump nozzle 19 such that the steering nozzle 20 is pivotable to the right and the left.

In the personal watercraft 1, by a rotational force of the impeller 14 of the water jet pump P driven by the engine E, water is taken in through the water intake 17 provided at the bottom portion of the hull 3, pressurized and accelerated to flow into the water passage 18. The resulting water flow is faired by the fairing vane 15, and a water jet is ejected in the rearward direction, from the ejection port of the pump nozzle 19 through the steering nozzle 20. As a reaction of the water jet elected from the water jet pump P through the steering nozzle 20, the personal watercraft 1 obtains a propulsive force for moving the body 2.

A steering handle bar 22 which can be gripped by the rider is provided at the front side of the deck floor 4*a*. The handle bar 22 is connected to the steering nozzle 20 via a steering cable (not shown). According to the rider's operation for tilting the handle bar 22 to the right or the left, the steering nozzle 20 is pivoted to the right or the left. Back mirrors 23 are provided in front of the handle bar 22.

A reverse bucket 24 with a bowl shape is provided in the vicinity of the steering nozzle 20. The reverse bucket 24 is rotatable around a rotational axis extending in the rightward and leftward direction. For example, by the rider's manual operation (manipulation) of a reverse lever (not shown) provided under the handle bar 22, the reverse bucket 24 rotates. The reverse bucket 24 is rotatable between a forward movement position and a rearward (backward) movement position. At the forward movement position, the reverse bucket 24 is moved to and located at an upper side of the steering nozzle 20 so that the whole of the ejection port of the steering nozzle 20 opens in the rearward direction (to the rear). At the rearward movement position, the reverse bucket 24 is moved to and located at a lower side of the steering nozzle 20 to cover the whole of the ejection port of the steering nozzle 20 from the rear.

The reverse bucket 24 shown in FIG. 1 is at the forward movement position at which the ejection port of the steering nozzle 20 opens in the rearward direction. At the forward movement position, the reverse bucket 24 causes the water jet ejected from the steering nozzle 20 to move in the rearward direction, and thus the body 2 is moved in a forward direction. When the reverse bucket 24 is rotated to the rearward movement position at which the ejection port of the steering nozzle 20 is covered from the rear by the reverse bucket 24, the direction of the water jet ejected from the steering nozzle 20 is changed to the forward direction, and thus the body 2 is moved in the rearward direction.

As shown in FIGS. 2 to 4, the deck 4 includes the depressed part 4*c* formed by depressing a portion of the deck 4, the portion being located rearward of the seat 5. The player is seated on the depressed part 4*c* in a state in which the player sees the rearward (backward) side and the player can quickly start to play the water sport such as the wakeboarding.

The depressed part 4*c* is integrated with the deck floor 4*a*. The depressed part 4*c* is provided at the deck floor 4*a* to overlap with the seat 5 in the forward and rearward direction. For example, the depressed part 4*c* has a shape which is symmetric in the rightward and leftward direction. The depressed part 4*c* includes a bottom wall surface 4*d*, a pair of right and left side wall surfaces 4*e*, and a front wall surface 4*f*.

The bottom wall surface 4*d* extends in the forward and rearward direction and in the rightward and leftward direction. The bottom wall surface 4*d* has a dimension in the rightward and leftward direction (width), which increases from the front to the rear. The bottom wall surface 4*d* is inclined in a downward direction (has a downward slope) from the front to the rear. With this structure, the player can be easily seated on the bottom wall surface 4*d* from the rear to the front. In addition, the player can easily raise the player's body from the front to the rear. When viewed from the side (in a side view), the bottom wall surface 4*d* extends linearly in the forward and rearward direction.

The pair of right and left side wall surfaces 4*e* are provided on right and left sides of the bottom wall surface 4*d* and extend upward from the side ends of the bottom wall surface 4*d*. For example, the pair of right and left side wall surfaces 4*e* are inclined in the upward direction (have an upward slope), from the side ends of the bottom wall surface 4*d* to lateral sides. With this structure, for example, even in a case where the player is seated on the depressed (recessed) part 4*c* in a state in which the player is equipped with stuff such as a life jacket, the right and left side wall surfaces 4*e* do not interfere with the player's body. Also, the player can easily move the player's body to the right and the left. The dimension (height) in the upward and downward direction, of each of the side wall surfaces 4*e*, increases from the rear to the front. With this structure, the right and left parts of the player seated on the depressed part 4*c* can be easily supported by the side wall surfaces 4*e*.

The front wall surface 4*f* extends upward from the front end of the bottom wall surface 4*d*. For example, the front wall surface 4*f* is inclined in the upward direction (has an upward slope) as it extends forward from the front end of the bottom wall surface 4*d*. In this structure, the front wall surface 4*f* does not interfere with the body of the player seated on the depressed part 4*c*, and the rear part of the body of the player who sees a rearward (backward) side is easily supported by the front wall surface 4*f*. As shown in FIG. 3, in the present embodiment, the front wall surface 4*f* is inclined at an angle larger than an angle at which the rear portion of the seat support part 4*b* is inclined. The upper end of the front wall surface 4*f* is located rearward of the rear end of the connection member 25. In this structure, the connection member 25 does not interfere with the rear part of the body of the player.

As shown in FIG. 2, when viewed from above (in a top plan view), the upper end of the front wall surface 4*f* has a circular-arc shape in which it extends in the rightward and leftward direction, and a center portion in the rightward and leftward direction swells (protrudes) from the front to the rear. The center portion in the rightward and leftward direction, of the upper end of the front wall surface 4*f*, is located forward of a middle point in the forward and rearward direction, of a region between the rear end of the seat support part 4*b* and the rear end of the deck floor 4*a*. This structure makes it possible to ensure a length of the depressed part 4*c* in the forward and rearward direction so that the player can be stably seated on the depressed part 4*c*.

As shown in FIGS. 2 to 4, the depressed part 4*c* has an inner space S surrounded by the bottom wall surface 4*d*, the pair of right and left side wall surfaces 4*e*, and the front wall surface 4*f*, and opens in the rearward direction (to the rear). The minimum width of the inner space S is set sufficiently larger than the width of the waist part of the player with an average construction. However, even in a case where the minimum width of the inner space S is set smaller than the width of the waist part of the player, the player can be seated on the depressed part 4*c* and a region of the deck floor 4*a* which is in the vicinity of the depressed part 4*c*, because the side wall surfaces 4*e* are inclined.

For example, the maximum width of the depressed part 4*c* is larger than the maximum width of the seat 5. In the present embodiment, the inclination angles of the pair of right and left side wall surfaces 4*e* are equal to each other. However, the inclination angles of the right and left side wall surfaces 4*e* may be different from each other. Also, for example, when viewed from the side (in a side view), the bottom wall surface 4*d* may extend in the forward and rearward direction in a curved shape which is depressed (recessed) in the downward direction.

In the personal watercraft 1 as described above, the player is seated on the depressed part 4*c* including the bottom wall surface 4*d* extending in the forward and rearward direction and in the rightward and leftward direction, and thus the player can be stably seated on a portion of the deck 4 which is rearward of the seat 5 in a state in which the player sees a rearward (backward) side. When the player raises the player's body from the depressed part 4*c*, the player can quickly start to play the water sport such as the wakeboarding.

The inner space S of the depressed part 4*c* is surrounded by the bottom wall surface 4*d*, the right and left side wall surfaces 4*e* extending upward from the side ends of the bottom wall surface 4*d*, and the front wall surface 4*f* extending upward from the front end of the bottom wall surface 4*d*, and opens in the rearward direction (to the rear). Since the inner space S of the depressed part 4*c* opens in the rearward direction in this way, the player can raise the body from the depressed part 4*c* to the rear, and can quickly start to play the water sport such as the wakeboarding.

The personal watercraft 1 comprises the rear grip 8 protruding rearward from the rear portion of the seat 5. The rear end of the rear grip 8 is located forward of the upper end of the front wall surface 4*f*. In this structure, in a state in which the player is seated on the depressed part 4*c*, the rear end of the rear grip 8 does not interfere with, for example, the lifejacket attached to the upper half part of the body of the player. This makes it possible for the player to move the upper half part of the body as desired in a state in which the player is seated on the depressed part 4*c* and sees a rearward side.

The right and left side wall surfaces 4*e* are inclined in the upward direction, from the side ends of the bottom wall surface 4*d* to lateral sides. The front wall surface 4*f* is inclined in the upward direction, from the front end of the bottom wall surface 4*d* to the front. In this structure, the side wall surfaces 4*e* and the front wall surface 4*f* do not interfere with the player's body. Therefore, the player can be easily seated on the depressed part 4*c*.

The dimension in the upward and downward direction, of each of the side wall surfaces 4*e* increases from the rear to the front. With this structure, the body of the player seated on the depressed part 4*c* can be supported by the side wall surfaces 4*e*, and the body of the player can be easily raised from the depressed part 4*c* to the rear.

The dimension in the rightward and leftward dimension, of the bottom wall surface 4*d* increases from the front to the rear. With this shape of the bottom wall surface 4*d*, the player who sees a rearward side can be easily seated on the depressed part 4*c*.

The bottom wall surface 4*d* is inclined in the downward direction (has a downward slope) from the front to the rear. In a case where the player seated on the depressed part 4*c* shifts the center of gravity from the front to the rear, the body of the player can be easily raised to the rear. Even if water flows into the depressed part 4*c*, this water can be easily discharged from the depressed part 4*c*.

The rear grip 8 includes the first grip part 8*a* and the second grip part 8*b* disposed below the first grip part 8*a*, and the rear end of the second grip part 8*b* is located rearward of the rear end of the first grip part 8*a*. In the personal watercraft 1 including the first grip part 8*a* and the second grip part 8*b* disposed below the first grip part 8*a*, the player can be stably seated on the depressed part 4*c*, and the first grip part 8*a* and the second grip part 8*b* do not interfere with the stuff such as the life jacket attached to the upper half part of the body of the player. For example, in a case where the player rides on the personal watercraft 1 from underwater, the player grips the second grip part 8*b*, puts the rider's feet on the rear side of the deck floor 4*a*, and then grips the first grip part 8*a*. In this way, the player can ride on the personal watercraft 1 quickly and easily.

The deck 4 includes the seat support part 4*b* which extends upward from the upper surface of the deck floor 4*a* and supports the seat 5. The rear portion of the seat support part 4*b* is inclined in the upward direction (has an upward slope), from the rear to the front. In this structure, the rear portion of the seat support part 4*b* does not interfere with the body of the player seated on the depressed part 4*c*.

Numerous modifications and alternative embodiments of the present invention will be apparent to those skilled in the art in view of the foregoing description. Accordingly, the description is to be construed as illustrative only, and is provided for the purpose of teaching those skilled in the art the best mode of conveying out the invention. The details of the structure and/or function may be varied substantially without departing from the spirit of the invention.

What is claimed is:

1. A personal watercraft comprising:

a body including a deck; and a seat disposed on the deck at a location that is forward of a rear end of the deck, wherein the deck includes a depressed part formed by depressing a portion of the deck which is rearward of a rear end of the seat, wherein the depressed part includes:

a bottom wall surface extending in a forward and rearward direction and in a rightward and leftward direction, the bottom wall surface being configured for seating of a player; and side wall surfaces extending upward from side ends of the bottom wall surface and inclined outwardly in the rightward and leftward direction, and wherein, in a top view, the bottom wall surface has a dimension in the rightward and leftward direction which increases from a front to a rear, and the side wall surfaces have a dimension in the rightward and leftward direction which decreases from the front to the rear.

2. The personal watercraft according to claim 1, wherein the depressed part has an inner space surrounded by the bottom wall surface, the side wall surfaces and a front wall surface extending upward from a front end of the bottom wall surface, and wherein the inner space of the depressed part opens in a rearward direction.

3. The personal watercraft according to claim 2, further comprising:

a rear grip protruding in the rearward direction from a rear portion of the seat, wherein the rear grip has a rear end located forward of an upper end of the front wall surface of the depressed part.

4. The personal watercraft according to claim 2, wherein the side wall surfaces are inclined in an upward direction from the side ends of the bottom wall surface to lateral sides, and wherein the front wall surface is inclined in the upward direction from the front end of the bottom wall surface to a front.

5. The personal watercraft according to claim 1, wherein each of the side wall surfaces has a dimension in an upward and downward direction, which increases from a rear to a front.

6. The personal watercraft according to claim 1, wherein the bottom wall surface is inclined in a downward direction from a front to a rear.

7. The personal watercraft according to claim 3, wherein the rear grip includes a first grip part and a second grip part disposed below the first grip part, and wherein the second grip part has a rear end located rearward of a rear end of the first grip part.

8. The personal watercraft according to claim 6, wherein the deck includes a seat support part which extends upward from an upper surface of a deck floor of the deck and supports the seat, and wherein the seat support part has a rear portion inclined in an upward direction, from a rear to a front.

9. The personal watercraft according to claim 6, wherein the depressed part has a maximum width that is larger than a maximum width of the seat.

* * * * *